United States Patent [19]

Challis

[11] Patent Number: 4,596,307

[45] Date of Patent: Jun. 24, 1986

[54] FLUID DISCHARGE SILENCER

[76] Inventor: Louis A. Challis, P.O. Box 199, Kings Cross, 2011 N.S.W., Australia

[21] Appl. No.: 603,514

[22] Filed: Apr. 24, 1984

[30] Foreign Application Priority Data

Apr. 26, 1983 [AU] Australia ..... PF9047

[51] Int. Cl.[4] ..... F01N 1/08

[52] U.S. Cl. ..... 181/269; 181/239; 181/261; 181/270; 181/282

[58] Field of Search ..... 181/211, 212, 224, 232, 181/233, 238, 239, 255, 257, 260, 261, 267–270, 275, 282, 231

[56] References Cited

U.S. PATENT DOCUMENTS

| | | | |
|---|---|---|---|
| 1,522,111 | 1/1925 | Franck-Philipson | 181/270 X |
| 3,556,734 | 1/1971 | Peterson | 181/261 X |
| 4,164,266 | 8/1979 | Collin et al. | 181/255 X |
| 4,266,602 | 5/1981 | White et al. | 181/224 X |
| 4,428,453 | 1/1984 | Yuen et al. | 181/231 |

FOREIGN PATENT DOCUMENTS

| | | |
|---|---|---|
| 283008 | 2/1927 | United Kingdom . |
| 421669 | 9/1933 | United Kingdom . |
| 463466 | 6/1935 | United Kingdom . |
| 998591 | 9/1962 | United Kingdom . |
| 1335275 | 4/1971 | United Kingdom . |

*Primary Examiner*—Benjamin R. Fuller

*Attorney, Agent, or Firm*—Hayes, Davis & Soloway

[57] ABSTRACT

A fluid discharge silencer for steam or other vapors or gases (with or without entrained solids or liquids) has an expansion chamber into which the fluid is passed through an inlet duct which discharges the fluid over an extended region of the chamber, flow deflector means in the chamber gradually redirecting the flow of gas from the inlet duct to change the direction of flow and to permit the gas phase components of the fluid to expand; the expansion chamber has an outlet which in use is connected to a silencer such as a parallel splitter silencer for further attenuating noise in the discharge flow. The inlet duct can be an elongated pipe having a longitudinal discharge aperture arrangement discharging the fluid into a trough-like redirecting structure which removes entrained components and redirects the flow.

16 Claims, 6 Drawing Figures

FLUID DISCHARGE SILENCER

FIELD OF THE INVENTION

This invention relates to a silencer for gas or vapour discharges with or without entrained liquids or solids.

One example of such discharges which may be treated by an embodiment of the invention is a steam discharge, for example for a geothermal steam power generator or from a boiler system, the discharge occuring during the purging of the boiler pipes with steam. In these examples, steam is discharged at very high flow rates.

BACKGROUND TO THE INVENTION

When boilers in power stations require cleaning prior to commissioning, it is common practice to clean the boiler pipes in a purging operation involving discharging high velocity steam through the pipes. The high velocity steam moving through the pipes dislodges or dissolves deposits which are carried away in the form of solid projectiles or liquid drops with the steam. The steam, liquid and projectiles are vented from the boiler pipes to atmosphere at supersonic velocities.

Due to such steam discharges being at high velocity and in large quantities, there is a major problem of avoiding noise pollution. It is known to employ silencers to reduce to acceptable levels the noise of steam venting, but normally such silencers are rapidly destroyed by the combination of extremely high stream velocity and entrained particulate matter. Furthermore in the case of treating steam from geothermal sources which contains large quantities of water, silica and other contaminants, the silencers employed to silence steam emission are partially eroded at the entry by the silica and are contaminated by the silica downstream of the inlet.

Compressed gases or vapours discharged from safety valves may also require silencers. Normally a silencer should have negligible pressure drop to ensure correct resetting of the valve following the cessation of the discharge. Conventional silencers cannot achieve this low pressure drop without resorting either to very large dimensions or introducing flow path modifiers in the form of perforated plate diffusers or multiple wire grids.

It is considered that there is a need to provide new silencers for gas or vapour discharges which can cope with high rates of flow with or without entrained liquids or solids but which are reasonably economic to construct and maintain and are of a reasonable size.

SUMMARY OF THE INVENTION

In broad terms the present invention provides an apparatus for use in a silencer system through which a gas or vapour discharge is passed, the apparatus having an expansion chamber for permitting expansion of the discharge to reduce its velocity, the expansion chamber including (a) an outlet arranged for communicating with silencing means.

(b) an inlet duct for introducing the discharge into the expansion chamber over an extended region of the chamber, and (c) flow deflector means shaped for gradually redirecting the flow of gas or vapour from the inlet duct through the expansion chamber and to the outlet while allowing expansion of the gas or vapour discharge.

In accordance with the invention, since the gas or vapour is permitted to expand, this reduces its speed and hence the silencing means may be engineered to a less robust design and can be of more economic construction than would otherwise be required if the silencing means were subject to higher velocity flow.

If a simple nozzle is used for introducing the gas or vapour discharge into an expansion chamber, problems in design are encountered where high rates of flow occur. The present invention utilizes the extended region for introducing the discharge into the expansion chamber and this permits a very efficient and economical apparatus to be constructed. The apparatus can be relatively compact and also can avoid any substantial generation of undesirable noise in the expansion process, at least with preferred embodiments of the invention.

In general, embodiments of the invention can be advantageous by permitting one or more of the following features to be utilized:

(a) For a particular application the basic designed structure can simply be elongated to the desired extent to cope with the required mass flow rate.

(b) A modular design can be achieved thereby permitting extra modules to be added as an elongation of the structure to suit a particular application. This can obviate the expense of re-design and new fabrication arrangements for different applications.

(c) Design for a particular application can be simple and can obviate the complex calculations needed where scaling of a three dimensional design is involved.

(d) Embodiments of the invention can be of low profile facilitating easy and economic installations.

(e) Embodiments of the invention can utilise a vertical discharge from the outlet of the expansion chamber through a conventional type of silencer whereby efficiency, safety and economic construction coupled with long life and easy maintenance can be achievable.

(f) The nature of the design of at least a preferred embodiment of the invention reduces what might otherwise be structural design problems and what would otherwise be high stresses in elements of the apparatus.

(g) Conventional silencers usually rely upon progressive increase in cross-sectional area of the duct where expansion takes place and grids or the like are used to aid diffusion; such grids however regenerate noise and the present invention in preferred embodiments can obviate such grids or noise regeneration.

A preferred design for the inlet duct involves several features each of which can offer advantage and significance and each of the features described hereinafter may be used with advantage singly or in any combination. In the preferred form, the inlet duct has an elongated aperture or series of apertures spaced along the extended region and most preferable the inlet duct has a horizontal axis with the aperture or apertures facing downwardly; furthermore preferably the cross-sectional area of the duct decreases in the downstream direction to cause generally uniform dispersion of the discharge through the respective apertures or along each elongated aperture.

In a preferred embodiment, the gas is deflected through the apertures with a gradual change in direction so that there is little noise produced. The side edges of the apertures are preferably smoothly rounded.

A further significant feature of a preferred embodiment of the inlet duct is that very low back pressure only can be created during the flow redirection process and consequently an embodiment of the present invention could be used to silence safety valve emissions where negligible pressure drop is required to ensure correct reseating of the valve.

A preferred embodiment of the invention smoothly redirects the gas flow so that its direction is gradually changed and this can be very effective in slowing down the gas or vapour stream. Furthermore the deflector arrangement can cause solid or liquid contaminants to collide with the deflector surface rather than to follow the gas or vapour path and the solid particles can be collected on the deflector means for subsequent removal during maintenance and the liquid droplets can be collected so as to fall down and be drained away.

In one particularly important embodiment of the invention, the deflector means is provided by a curved plate structure and for convenience and for balancing forces, the plate structure can be formed as two curved trough-like portions joining at a longitudinally extending ridge which is positioned in spaced confronting relationship with the extended region into which the inlet duct discharges the gas or vapour stream. This causes the flow of gas or vapour to be divided into two parts flowing on opposite sides of the expansion chamber.

In some applications it can be useful to provide a spray of water or other liquid into the region where the gas or vapour flow is being redirected so as to cause condensation and reduction in volume of the gas or vapour flow. This feature can be of great economic benefit in reducing the volume of gas or vapour to be discharged through the silencing means and consequently the silencing means can be designed and constructed to handle only a lower flow rate than otherwise would be required. This feature can be especially beneficial when the gas or vapour discharge to be processed by the apparatus comprises steam, since a water spray is a cheap and effective method of reducing the volume of steam to be silenced. The water spray may be turned on when the steam velocity reaches a threshold level at which the expansion chamber and silencing means cannot adquately cope.

Embodiments of the present invention can conveniently and effectively use a splitter-type silencer such as that which is already known in the art, and with advantage this silencer can be arranged to discharge vertically upwardly from an elongated horizontally extending low profile embodiment of expansion chamber.

BRIEF DESCRIPTION OF THE DRAWINGS

Preferred embodiments of the invention will now be described with reference to the accompanying drawings wherein.

DETAILED DESCRIPTION OF THE DRAWINGS

Figure 1A:
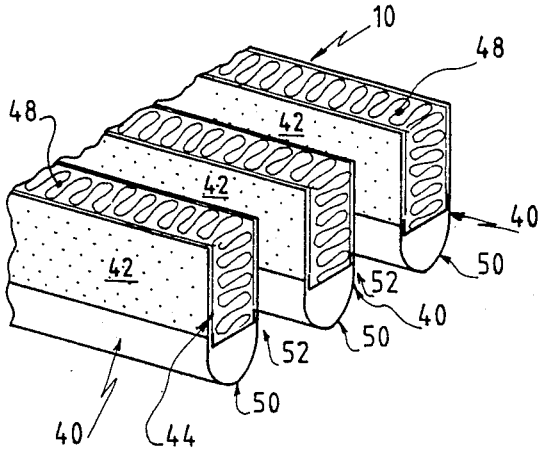
FIGS. 1 and 1A are a fragmentary schematic isometric view of a silencer embodying the invention and for silencing steam discharged from the pipe work of boilers in a power station during a purging operation.

Referring to the drawings, there is is shown a silencer structure comprising a reinforced cement block housing 2 having an acoustically treated door 9. An inlet pipe 4 leads into the housing for conveying discharge steam vented at supersonic velocities from the pipe work of a boiler arrangement of a power station when purging of the pipe work by steam takes place. Typically, the steam is emitted at flow rates up to about 300 kilograms per second and may carry supersonic projectiles and drops of liquid from dislodge deposits within the pipe work. The inlet pipe 4 extends into an expansion chamber 8 of the silencer with an elongated discharge zone of the pipe located above and confronting a trough-like flow deflector 6 which deflects the steam flow through 180° to discharge upwardly and expand. A parallel splitter silencer 10 is disposed above the expansion chamber 8 to receive the deflected steam flow and to discharge it to atmosphere.

Figure 5:
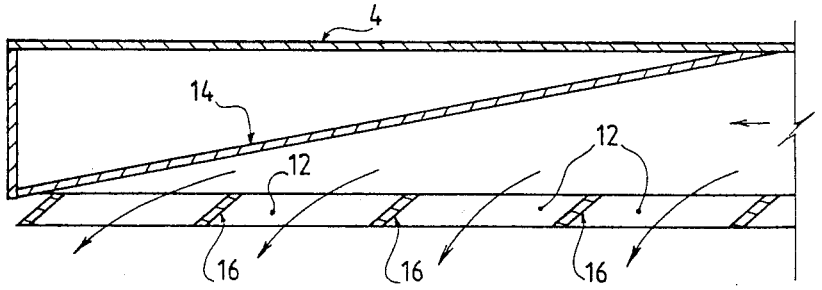
FIG. 5 is a diagrammatic longitudinal sectional view of the inlet pipe of the silencer.

At best seen from FIG. 5, the inlet pipe 4 has its discharge zone extending along its lower portion and formed by a series of longitudinally spaced, longitudinally elongated apertures 12. Within the pipe 4, a deflector plate 14 extends across and along the pipe over the elongated apertures 12 to reduce the cross-sectional area of the pipe 4 and to deflect the steam flow reasonable uniformly through the apertures 12. The apertures 12 are formed by angled partition plates 16 welded to the pipe 4 and providing a gradual change in the direction of flow of steam as it passes into and through the apertures 12. The partition plates 16 also function as a brace across a slot like opening in the inlet pipe. Since it is desirable to cause the flow path of the gas or vapour to change gradually to avoid generation of noise, smoothly curved shoulders 18 are provided (as shown in FIG. 1) along the sides of the apertures 12. Fabrication is achieved by cutting a slot in the pipe 1 and welding half pipe sections along weld line 19 to provide the shoulders.

The pipe 4 is of modular form and comprises sections connected at flanged joints 5, the pipe being supported on a frame work 7 above the flow deflector 6.

Figure 2:
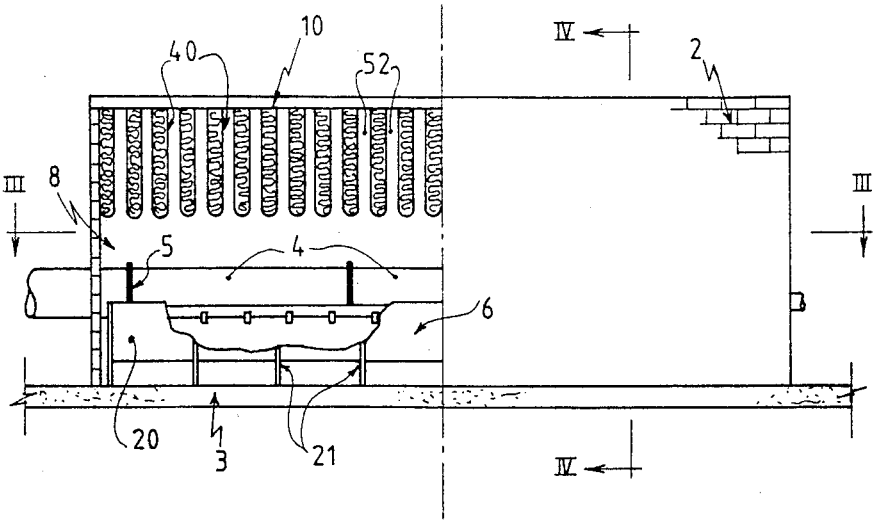
FIG. 2 is a half section side view of the entire silencer structure.
Figure 3:
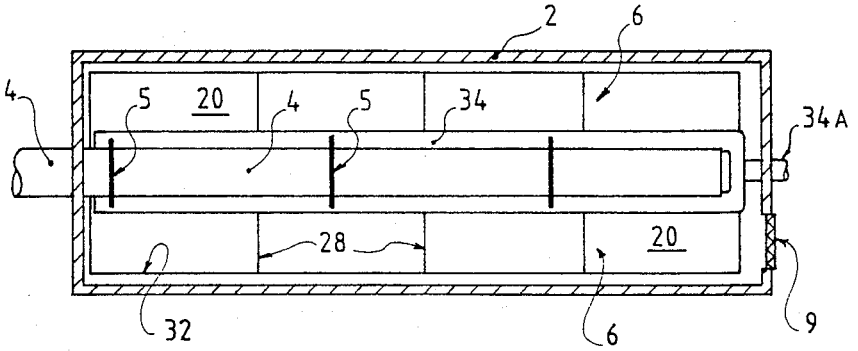
FIG. 3 is a cross-sectional plan view of the silencer taken along the line III—III of FIG. 2.
Figure 4:
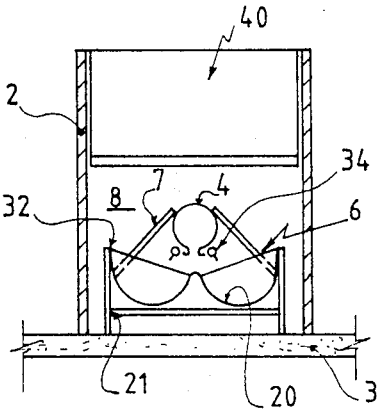
FIG. 4 is a cross-sectional end view of the silencer taken along the line IV—IV of FIG. 2.

The steam is discharged from the inlet apertures 12 into the expansion chamber 8 where the trough-like flow deflector 6 is disposed. The flow deflector 6 comprises two semi-cylindrical troughs 20 mounted on a frame 21 and joined to form a flow dividing ridge 24 which is adjacent to and faces the inlet apertures 12. The substantial equal flow division provides a balancing of forces within the expansion chamber and avoids twisting forces on the structure thereby simplifying economic construction. The steam is gradually redirected as it moves along the surface of the semi-cylindrical troughs 20 which are free from obstructions which would tend to create noise. During this change in flow direction, the steam expands and slows down by reason of drag forces created within the steam flow. Furthermore, as the steam flows vertically upwardly over the exterior of inlet pipe 4, the speed of the steam is greatly reduced. However, liquid drops or solid particles which may have been entrained in the steam generally will not be able to change direction with the steam and will collect on the troughs 20. The collected liquid, possibly with entrained solid particles, tends to flow under gravity down into the troughs and can be discharged through a drain (not shown) at the trough end. However, a large proportion of the liquid drops and entrained solid particles will be blown by the steam flow upwardly and over the outer edges 32 of the troughs to spill into a drain system 30 (omitted for clarity from FIGS. 2–4).

Transverse end or divider plates 28 are provided as desired at spaced locations along the troughs to slow down or prevent flow of the steam along the troughs.

For the purpose of condensing the steam and reducing its volume and velocity, water spray nozzles 36 are disposed along either side of the inlet apertures 12, the nozzles being connected to respective water pipes 34 connected to a single supply pipe 34A. The water spray contacts the steam as it is being redirected by the troughs and excess water spray and condensate collects in the troughs 20.

Figure 1:
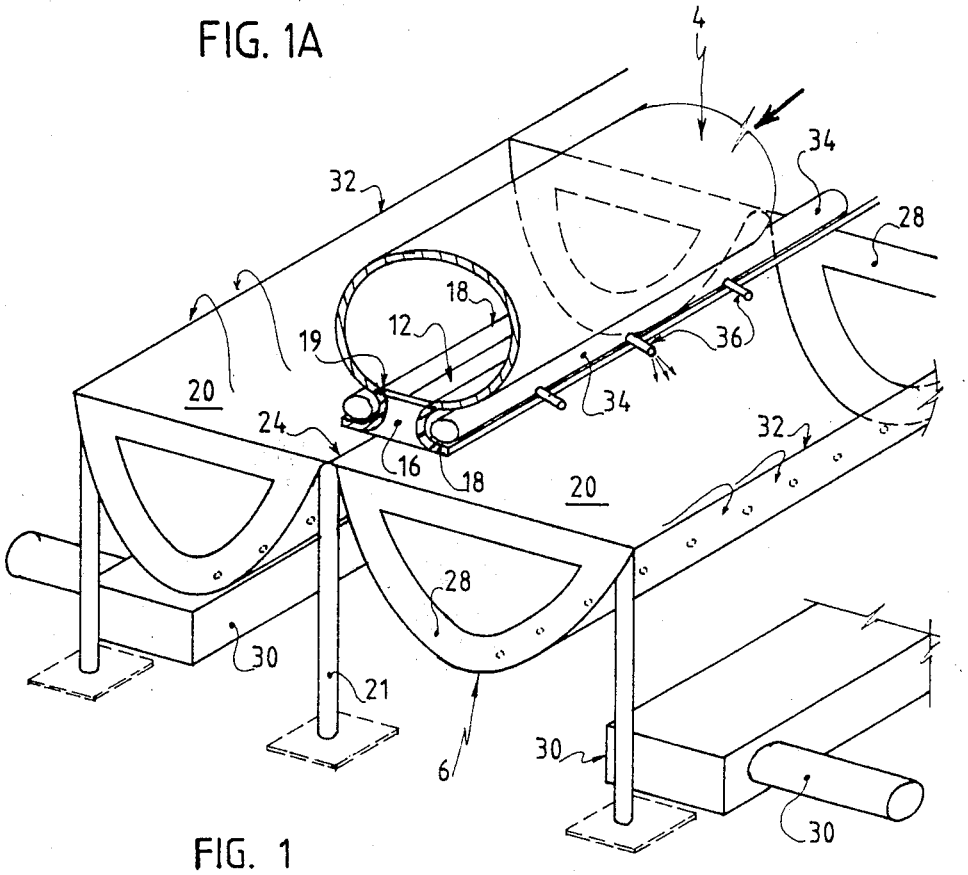

FIG. 1A shows schematically and partially the principal components within the housing. In detail there is shown the components of a conventional parallel splitter silencer 10 extending vertically and comprising a number of parallel silencer modules 40 each of similar design. Each of the modules comprises spaced parallel side plates 42 mounted on respective frame works 44, the plate 42 being perforated and accommodating acoustic absorption material 48 there between. Each module has a part-cylindrical lower nose portion 50 acting as a steam flow divider. Steam from the expansion chamber flows upwardly either side of the inlet pipe 4 and between the modules 40 through the discharge passages 52, the steam having essentially laminar flow.

After passing through the splitter silencer 10, the steam is vented to atmosphere.

The embodiment of the invention described above can be relatively compact and economic to construct. A typical structure is designed to be effective for steam flow rates of up to about 250 kilograms per second; the steam is slowed to about 50 meters per second so that the flow can be handled by a silencing structure which is of reasonable size. For greater steam flow rates, e.g. up to about 350 kilograms per second, the water spray arrangement can be used to reduce significantly the steam volume.

Figure 6:
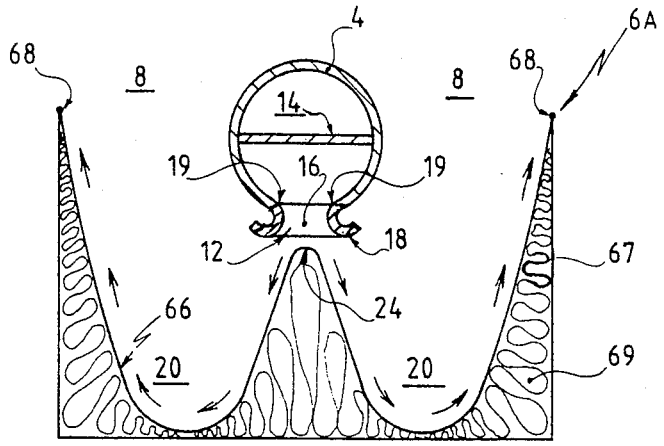
FIG. 6 is a schematic cross-sectional view of a second embodiment of a flow deflector for the expansion chamber.

FIG. 6 shows an alternative flow deflector 6A which can be substituted into the embodiment of FIGS. 1–5. The difference is that the troughs 20 are formed from a single curved steel sheet 66 mounted in a steel casing 67 and fixed thereto only along the top marginal edges 58. Acoustic absorbing infill 69 fills the space between the sheet 66 and casing 67. This design permits accommodation of thermal stresses and expansion in an effective manner.

I claim:

1. An apparatus for use in a silencer system through which a gas or vapour discharge is passed, the apparatus having an expansion chamber for permitting expansion of the discharge to reduce substantially its velocity, the expansion chamber including an outlet arranged for communicating with silencing means an inlet duct elongated along an axis and having a substantially closed side wall extending around the axis of elongation of the inlet duct and an axially elongated transversely directed smooth gas discharge configuration interrupting said side wall and extending therealong in a zone constituting a minor proportion of the inlet duct wall area for introducing the discharge into the expansion chamber over an extended region of the chamber, flow deflector means shaped for gradually redirecting the flow of gas or vapour from the inlet duct through the expansion chamber and to the outlet while allowing expansion of the gas or vapour discharge, the outlet providing a gas flow direction substantially at right angles to the direction of elongation of the inlet duct.

2. An apparatus as claimed in claim 1 wherein the expansion chamber is a horizontally elongated structure and the inlet duct discharge configuration has a aperture arrangement extending horizontally substantially completely along the expansion chamber.

3. Apparatus as claimed in claim 1, and wherein the inlet duct is elongated in a horizontal direction and the outlet is arranged to extend substantially vertically upwardly.

4. Apparatus as claimed in claim 1 and comprising a plurality of modules from which the expansion chamber is fabricated, each of the modules including a portion of inlet duct, a portion of expansion chamber region with a portion of the flow deflector means and a portion of the outlet for the apparatus.

5. Apparatus as claimed in claim 1 and including a liquid spray nozzle arrangement for spraying liquid into said chamber for impingment upon the gas or vapour discharge as it is being redirected and for causing condensation of liquid components of the discharge in order to reduce its volume.

6. Apparatus as claimed in claim 1, wherein the inlet pipe has means for reducing the cross-sectional area along said extended region to provide substantially uniform gas or vapour discharge into the expansion chamber.

7. Apparatus as claimed in claim 1, wherein said gas discharge arrangement is a substantially continuous slot in said side wall and has smooth curved edges.

8. Apparatus as claimed in claim 1, wherein the outlet provides a gas flow direction at approximately 180° to the laterally directed discharge from said inlet duct.

9. Apparatus as claimed in claim 1, and constructed and dimensioned for controlling flow of a high velocity, high mass flow discharge of a power station boiler.

10. An apparatus for use in a silencer system through which a gas or vapour discharge is passed, the apparatus having an expansion chamber for permitting expansion of the discharge to reduce substantially its velocity, the expansion chamber including an outlet arranged for communicating with silencing means, an inlet duct elongated along an axis and having a substantially closed side wall extending around the axis of elongation of the inlet duct and an axially elongated transversely directed smooth gas discharge configuration interrupting said side wall and extending therealong in a zone constituting a minor proportion of the inlet duct wall area for introducing the discharge into the expansion chamber over an extended region of the chamber, flow deflector means shaped for gradually redirecting the flow of gas or vapour from the inlet duct through the expansion chamber and to the outlet while allowing expansion of the gas or vapour discharge, the outlet providing a gas flow direction substantially at right angles to the direction of elongation of the inlet duct, the aperture arrangement being directed vertically downwardly and the deflector means comprising a curve plate structure confronting the aperture arrangement.

11. An apparatus as claimed in claim 3, wherein the curved plate structure is trough-like to allow liquid or solid particles in the gas or vapour discharge to collect in the trough-like structure.

12. An apparatus as claimed in claim 11, wherein the trough-like structure is elongated and has a generally central ridge extending in its direction of elongation to divide the trough structure into two trough portions, said ridge being substantially aligned with and confronting said aperture arrangement.

13. Apparatus as claimed in claim 11, and wherein said flow deflector means comprises a curved plate structure which is mounted at its respective side portions in a housing with acoustic absorbent infill provided in a cavity located between the housing and the face of the curved plate structure opposite to that on which the gas or vapour discharge impinges.

14. Apparatus for use in a silencer system through which a gas or vapour discharge is passed, the apparatus having an expansion chamber for permitting expansion of the discharge to reduce substantially is velocity, the expansion chamber including an outlet arranged for communicating with silencing means, an inlet duct elongated along an axis and having a substantially closed side wall extending around the axis of elongation of the inlet duct and an axially elongated transversely directed smooth gas discharge configuration interrupting said side wall and extending therealong in a zone constituting a minor proportion of the inlet duct wall area for introducing the discharge into the expansion chamber over an extended region of the chamber, flow deflector means shaped for gradually redirecting the flow of gas or vapour from the inlet duct through the expansion chamber and to the outlet while allowing expansion of the gas or vapour discharge, and the outlet providing a gas flow direction substantially at right angles to the direction of elongation of the inlet duct, said inlet duct comprising an elongated pipe structure formed from curved metal sheet with an opening extending axially along one side of the structure, each of the edges of the opening being formed by a smoothly curved shoulder extending on the outer side of the pipe.

15. Apparatus as claimed in claim 14, and wherein the opening in the pipe is interrupted by a plate arrangement so as to provide a series of longitudinally spaced discharge apertures.

16. Apparatus as claimed in claim 15 wherein said plate arrangement provides angled walls at each end of each aperture in its longitudinal direction for smoothly deflecting the discharge from axial motion along the inlet pipe to motion through the aperture and into the expansion chamber, the flow redirection being through approximately 90°.

* * * * *